US007696419B2

(12) United States Patent
Chadwick, V

(10) Patent No.: US 7,696,419 B2
(45) Date of Patent: Apr. 13, 2010

(54) COLLAPSIBLE STRINGED MUSICAL INSTRUMENT

(76) Inventor: Richard William Chadwick, V, 607 River Ridge Ct., Nashville, TN (US) 37221

( * ) Notice: Subject to any disclaimer, the term of this patent is extended or adjusted under 35 U.S.C. 154(b) by 0 days.

(21) Appl. No.: 11/873,744

(22) Filed: Oct. 17, 2007

(65) Prior Publication Data

US 2009/0100981 A1 Apr. 23, 2009

(51) Int. Cl.
*G10D 3/00* (2006.01)
*G10D 1/00* (2006.01)

(52) U.S. Cl. ..... 84/293; 84/173; 84/274; 84/275; 84/290; 84/291

(58) Field of Classification Search ..... 84/293
See application file for complete search history.

(56) References Cited

U.S. PATENT DOCUMENTS

| | | | | | |
|---|---|---|---|---|---|
| 3,629,900 | A | * | 12/1971 | Beerli, Jr. | 16/349 |
| 4,073,211 | A | * | 2/1978 | Jorgensen | 84/291 |
| 4,132,143 | A | * | 1/1979 | Stone | 84/314 R |
| 4,191,085 | A | | 3/1980 | Litwin | 84/293 |
| 4,686,882 | A | | 8/1987 | Shaw | 84/291 |
| 5,233,896 | A | | 8/1993 | Worthington et al. | 84/293 |
| 5,383,385 | A | | 1/1995 | Gilbert | 84/267 |
| 5,390,578 | A | | 2/1995 | Raymer | 84/291 |
| 5,817,959 | A | * | 10/1998 | Kagan | 84/280 |
| 6,025,548 | A | * | 2/2000 | Ehrlich | 84/291 |
| 6,037,532 | A | * | 3/2000 | Beckmeir | 84/293 |
| 6,353,164 | B1 | | 3/2002 | Corsi | 84/293 |
| 2001/0052281 | A1 | * | 12/2001 | Minakuchi | 84/291 |

OTHER PUBLICATIONS

Exhibit B entitled "Czech-Ease Portable Bass".
Exhibit C entitled "Eminence Portable Upright Bass".
Exhibit D entitled "Palatino Electric Upright Bass".

* cited by examiner

*Primary Examiner*—Jeffrey Donels
*Assistant Examiner*—Christopher Uhlir
(74) *Attorney, Agent, or Firm*—Waddey & Patterson PC; I. C. Waddey, Jr.

(57) ABSTRACT

A collapsible stringed instrument having a body with a soundboard, a back face, a neck, and a spacer. The perimeter of the soundboard is connected to the perimeter of the back face by the spacer. The volume between the spacer, the soundboard, and the back face define a sound chamber. The neck is pivotally and laterally coupled to the body which has a door in the back face. The neck is able to pivot and slide through the door and into the sound chamber.

19 Claims, 8 Drawing Sheets

COLLAPSIBLE STRINGED MUSICAL INSTRUMENT

BACKGROUND OF THE INVENTION

The present invention relates generally to transporting stringed musical instruments. Transporting stringed musical instruments is an endeavor with many perils. This is especially true for stringed musical instruments such as guitars, cellos, violas, violins, and basses. Because these instruments have elongated necks with tensed, exposed strings extending between the neck and the body, they are extremely susceptible to imprudent handling. However, those desiring to transport their instruments are not entirely without recourse.

Transporting stringed musical instruments in hard shell cases does help alleviate several of the problems associated with travel. Unfortunately, for some instruments, such as the upright bass, these hard shell cases are often too bulky to fit in cars. Moreover, air travel is no less vexatious. The hard shell cases are typically larger than the mandates, promulgated by the air lines, concerning carry-on baggage. However, even if the instrument is allowed on the airplane, whether as carry-on baggage or stored in the cargo compartment, transporting it in a hard shell case does not ensure that it will arrive at its destination undamaged.

Another option is traveling with the musical instrument in a soft bodied bag. Although these soft travel bags maybe accommodable in places the hard shell cases are not, they offer very little protection. A third option is to rent an instrument at your destination. In addition to expending funds to rent an instrument, rental instruments are often of inferior quality, dissimilarly configured, and of unfamiliar "feel."

Thus, what is needed is a stringed musical instrument that collapses into a completely self-contained enclosure. Allowing the instrument to collapse into a smaller form factor alleviates many of the problems discussed above. Additionally, it would be desirable to have a collapsible instrument that securely stores all of the components removed during the collapsing process. Furthermore, it would be expedient for the collapsible instrument to retain sound characteristics similar to those of its standard, non-collapsible counterparts. The problematic nature of traveling with stringed musical instruments is not a conundrum that has gone unnoticed. Prior attempts to solve this dilemma are described below.

U.S. Pat. No. 6,353,164 issued Mar. 5, 2002 to Stephen David Corsi discloses a stringed instrument with a neck pivotally attached to the body so as to allow the neck to rotate from an extended playing position to a folded traveling position.

U.S. Pat. No. 6,025,548 issued Feb. 15, 2000 to Raymond Seth Ehrlich discloses an acoustic guitar having a body divided into an upper and lower half, and a detachable neck. The upper and lower halves may be separated to allow the detachable neck to stow therein.

U.S. Pat. No. 5,390,578 issued Feb. 21, 1995 to Thomas G. Raymer discloses a guitar having a pivotally mounted neck that may pivot from a normal playing position to a fully stowed position within the perimeter of the guitar body. The guitar body contains a recess complementary to the neck in which the neck is received, after the neck pivots inside the perimeter of the guitar, so that the guitar is then in a travel configuration.

U.S. Pat. No. 5,383,385 issued Jan. 24, 1995 to Clifford W. Gilbert discloses a multi-segmented articulatable guitar having a neck pivotally attached wherein the neck is able to pivot towards the playing face of the guitar body and rest thereon.

U.S. Pat. No. 5,233,896 issued Aug. 10, 1993 to Bradford P. Worthington and Christian Allgor also discloses a stringed instrument having a neck pivotally connected to the body wherein the neck is allowed to pivot from a playing position over towards the playing face of the stringed instrument and rest thereon.

U.S. Pat. No. 4,686,882 issued Aug. 18, 1987 to Eric D. Shaw also discloses an acoustic guitar having a neck pivotally attached to the guitar body so as to allow the neck to pivot over onto the soundboard portion of the body.

U.S. Pat. No. 4,073,211 issued Feb. 14, 1978 to Allan C. Jorgensen describes a guitar having a hinged neck and a recess in the body of the guitar shaped to receive the neck when the neck folds towards the back portion of the guitar on its pivot.

U.S. Pat. No. 4,191,085 issued Mar. 4, 1980 to Bradley N. Litwin discloses a stringed musical instrument having three detachable portions-the sound box, the neck, and a removable portion of the upper surface of the sound box. The upper surface of the sound box can be removed allowing the detachable neck to be stored inside the sound box.

Although the prior art discloses a plethora of collapsible stringed music instruments, none provide a collapsible stringed musical instrument that is travel friendly; completely self contained; preserves the rich sound characteristics of a standard, non-folding acoustic musical instrument; and transitions from a collapsed travel form into a playing configuration, and vice versa, without requiring special skills or the aid of any tools.

BRIEF SUMMARY OF THE INVENTION

The present invention is directed at a stringed musical instrument that is conducive to traveling, completely self contained, does not sacrifice sound quality, and is easily collapsed and reassembled. In one preferred embodiment the invention has a neck that is pivotally and laterally coupled to the body of the instrument. The body has a door that allows the neck to pivot and laterally slide through the door and into the body of the instrument. This is facilitated, in part, by lessening the tension on the strings so that the tailpiece may be removed from the body. Once the tailpiece has been removed from the body, and the tension of the strings no longer compels the neck and body to remain in an extended playing position, the neck is free to pivot and slide towards the back of the body, through the door, and store therein. The interior of the body provides fasteners adapted to receive the removed tailpiece, along with any other loose pieces, so that they may be securely stored in the body.

Because the neck is able to both pivot and slide laterally relative to the body and collapse through the door into the body, the instrument can be configured in a form factor not significantly larger than the body itself, without the aid of a recess. Any recess or other compromise to the shape of the body distorts the sound produced by the instrument, as compared to an instrument with an unaltered body. As the one preferred embodiment eschews the pitfalls associated with providing a recess in the body, while still allowing the instrument to fold into a compact form factor, the present invention retains its true sound characteristics.

In preparation for travel, one preferred embodiment directed at an upright bass, allows the instrument to be collapsed and any removed components to be securely stowed in the body. The invention envisions, but is not limited to, storing the tailpiece, the strings, the endpin, and the fingerboard in the body without the need for any tools. Once the instrument reaches its destination, the door may be opened allowing the neck to slide and pivot out through the door to an extended, playing position. Next, all of the stored components can be removed so that the instrument may be reassembled.

As such, the present invention discloses a stringed musical instrument that is able to collapse into a completely self contained package that facilitates traveling. Moreover, the present invention discloses an apparatus that does not adversely affect the quality of sound generated by the instrument.

Accordingly it is an object of the present invention to provide a stringed musical instrument that is amenable to traveling.

It is an additional object of the present invention to provide a stringed musical instrument amenable to traveling without deteriorating the quality of sound produced by the instrument.

It is yet another objective of the present invention to provide a stringed musical instrument that is amendable to traveling, does not distort the quality of sound generated by the instrument, and allows all of the components removed during the collapsing process to be housed inside the body of the instrument.

Finally, it is an object of the present invention to provide a stringed musical instrument that converts between traveling and playing configurations in a quick, simple manner.

DETAILED DESCRIPTION OF THE INVENTION

The present invention relates generally to a collapsible stringed musical instrument capable of withstanding the rigors and demands of travel. More specifically, the present invention relates to a collapsible stringed acoustic musical instrument that can be folded into a smaller form factor that eases transportation problems and protects the fragile components of the instrument. The present invention is directed primarily at instruments such as cellos, and double basses. However, those of ordinary skill in the arts will appreciate the invention is not solely limited to the instruments named above.

Figure 5:
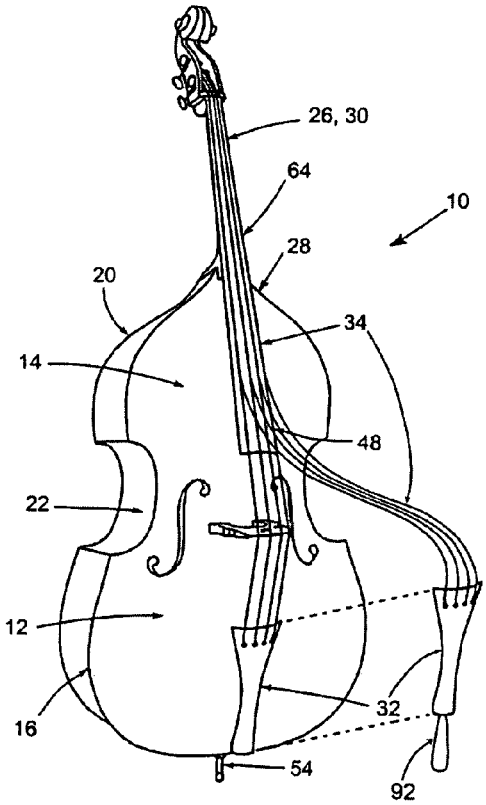
FIG. 5 is a perspective of the stringed musical instrument.

Now referring to the figures, FIG. 5 shows a collapsible stringed musical instrument 10. Specifically, FIG. 5 depicts an upright bass 10. The musical instrument 10 has a body 12, also referred to as a hollow body 12 or an instrument base 12. When the musical instrument 10 is in a playing position as shown in FIG. 5, the body 12 has a soundboard 14 adjacent the plurality of strings 34. The soundboard 14 is typically a thin board whose vibrations reinforce the sound of the musical instrument 10 resulting from the movement of the plurality of strings 34 proximate the soundboard 14. The soundboard 14 is also referred to as a playing face 14 or a belly 14, in the context of an upright bass. The soundboard 14 has a first perimeter 16, or a first border 16, that defines the expanse of the soundboard 14.

Figure 6B:
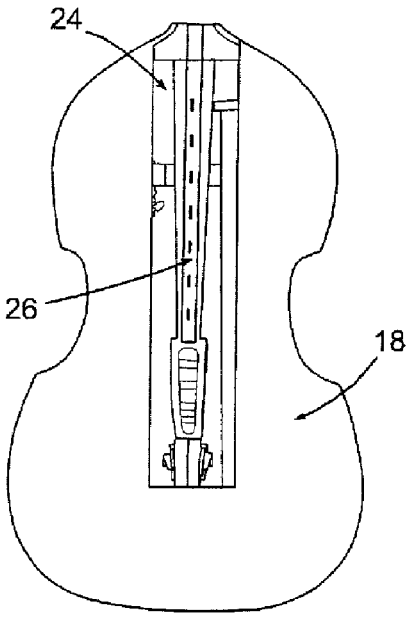
FIG. 6*b* is a rear view of the stringed musical instrument illustrating the opened door and the neck and fingerboard stored in the body of the instrument.
Figure 6C:
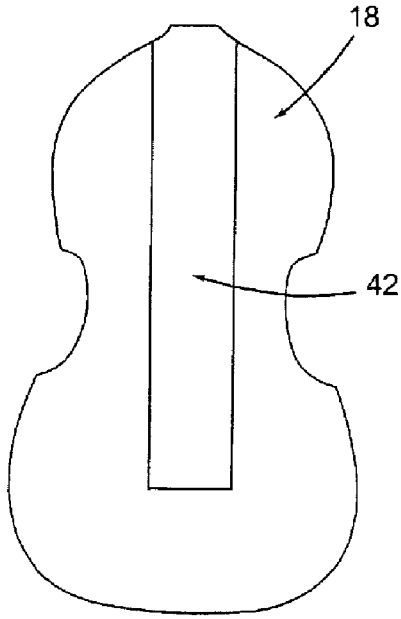
FIG. 6*c* is a rear view of the stringed musical instrument in a fully collapsed position with the door closed.
Figure 6A:
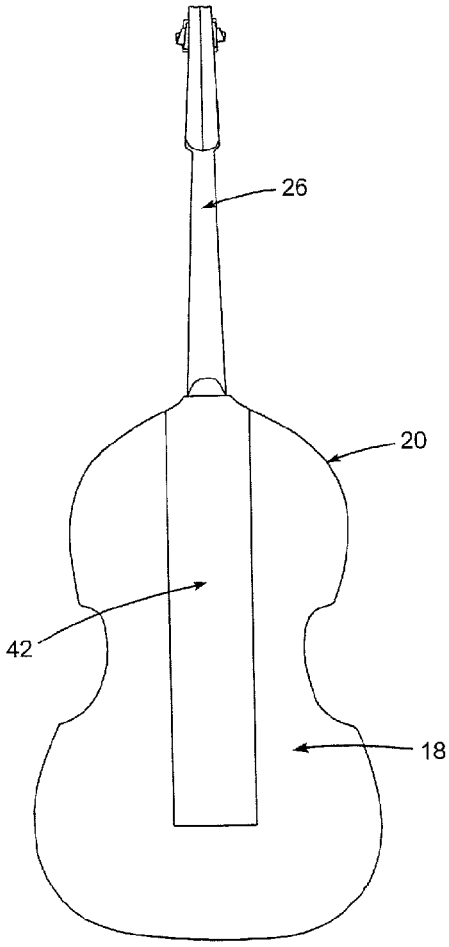
FIG. 6*a* is a rear view of the stringed musical instrument, showing the door, in an extended playing position.
Figure 7:
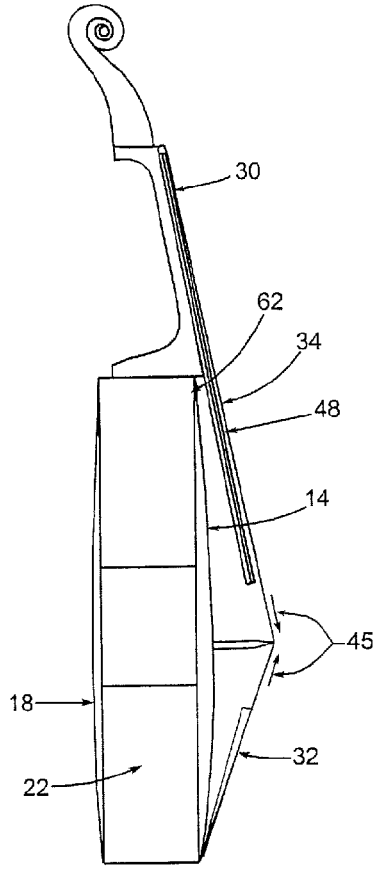
FIG. 7 is a side view showing the tensive force applied between the neck and the body.

As shown in FIGS. 6*c* and 7 the body 12 is also composed of a back face 18, also referred to as a back plate 18 or a back surface 18. The back face 18 opposes the soundboard 14. The back face 18 has a second perimeter 20, or a second border 20, that defines the expanse of the back face 18 as shown in FIGS. 5 and 6*a*. The body 12 also has a spacer 22, or periphery member 22, that extends between the first perimeter 16 of the soundboard 14 and the second perimeter 20 of the back face 18, as illustrated in FIGS. 5 and 7. FIG. 7 shows the relationship between the back face 18 and the soundboard 14 as being generally parallel from each other, as is typically seen in most acoustic stringed musical instruments. FIGS. 5 and 7 also show the spacer 22 extending between the first and second perimeters 16, 20 to form a wall or side brace.

Effectively, the spacer 22 encloses the volume between the soundboard 14 and the back face 18. Now referring to FIGS. 3 and 6*b*, the enclosed volume defined between the soundboard 14, the back face 18, and the spacer 22 is a sound chamber 24. The sound chamber 24 is also referred to as an interior 24 or a chamber 24. The sound chamber 24 aids in projecting the resonances of the soundboard 14 caused by the vibration of the plurality of strings 34 as the strings are displaced when the instrument 10 is played.

Thus, it is readily apparent that the spatial arrangement between the soundboard 14, the back face 18, and the spacer 22, defining the sound chamber 24, has a substantial impact on the characteristics of the sound produced by the stringed instrument 10. As such, recesses or deformations in the sound chamber 24 will have an impact on the sound produced by the musical instrument 10. Resultantly, it is desirable to have an unadulterated sound chamber 24.

Figure 1A:
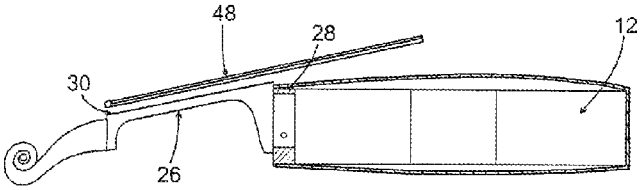
FIGS. 1*a*-1*e* are semi-transparent illustrations of the neck sliding and pivoting into the body of the stringed musical instrument.
Figure 1B:
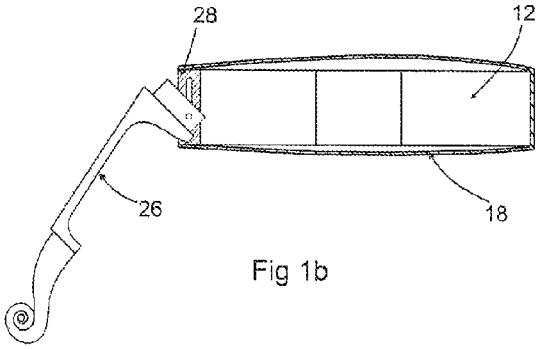
Figure 1D:
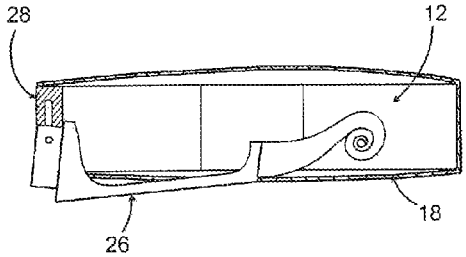
Figure 1E:
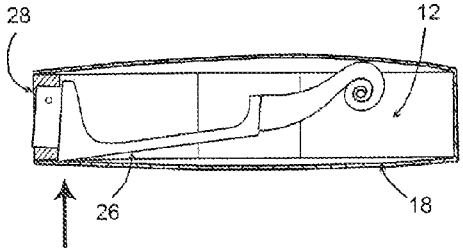
Figure 1C:
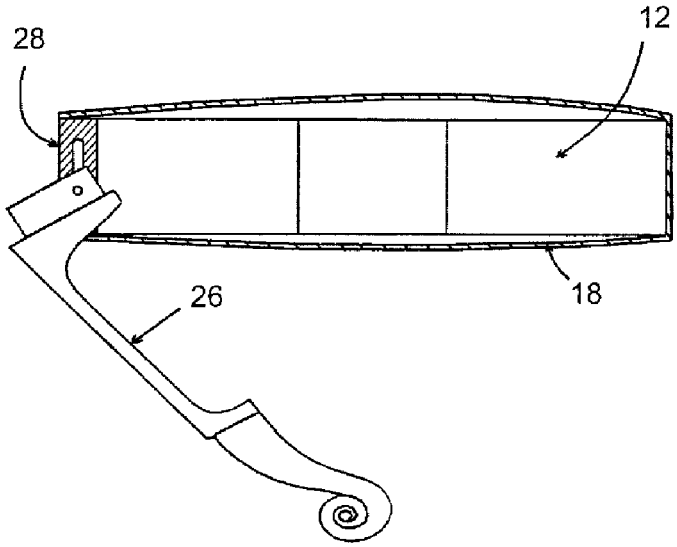
Figure 3:
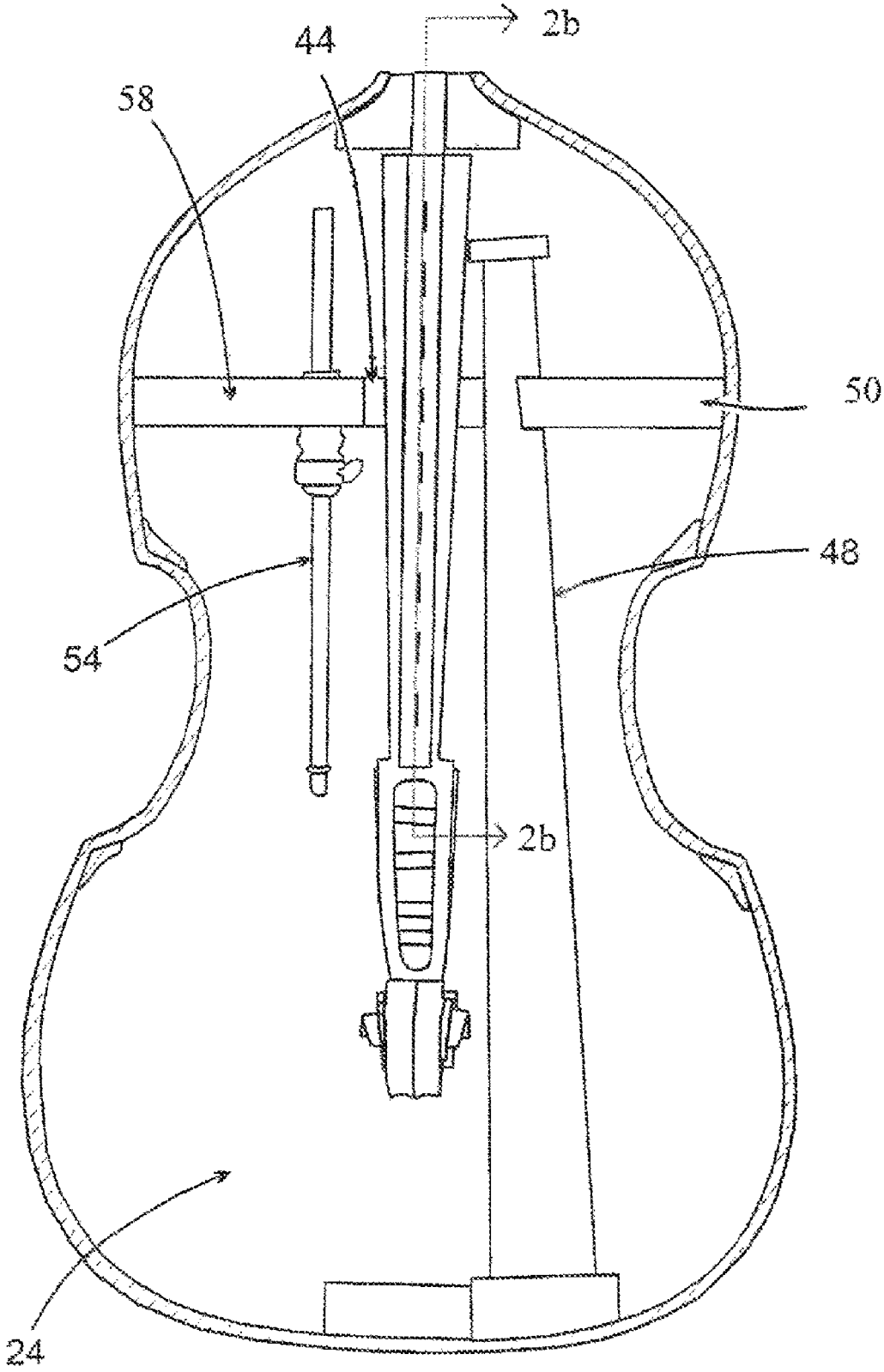
FIG. 3 is a transparent view of the rear of the stringed musical instrument depicting the fingerboard, the neck, and the endpin secured and stored within the body of the stringed musical instrument.

FIGS. 1*a*-1*e* show a cross-section of the instrument 10 taken at line 2*b* of FIG. 3. The stringed instrument 10 also has an elongated neck 26 that is both pivotally and laterally coupled to a top portion of the body 28, also referred to as the near end of the body 28. Because of the pivotal and lateral coupling, the neck 26 is able to pivot relative to the soundboard 14. As shown in FIGS. 1*b*-1*d*, the neck 26 is able to pivot downward towards the back of the stringed musical instrument 10; namely, the back face 18. Additionally, the coupling between the neck 26 and the top portion of the body 28 allows the neck 26 to slide laterally, relative to the body 12. FIGS. 1*d*-1*e* show the neck laterally sliding. However, in an alternate embodiment, the neck 26 is only pivotally coupled to the body 12.

The neck 26 has a front surface 30, also referred to as the anterior surface of the neck 30. The front surface of the neck 30 is proximate the plurality of strings 34 when the stringed musical instrument 10 is in a playing position as shown in FIGS. 1*a*, 5, and 7. The playing position, also known as the first position, describes the position of the neck 26 relative to the body 12, where the neck 26 and the body 12 are in a fully extended position or in an extended collinear relationship. The playing position is analogous to the configuration of the instrument 10 that would allow a musician to play the instrument 10 in the normal course.

The stringed musical instrument 10 also has a tailpiece 32 as shown in FIG. 5. The plurality of strings 34 is stretchedly engaged between the tailpiece 32 and the front surface of the neck 30. Because the plurality of strings 34 is stretched between the tailpiece 32 and the front surface of the neck 30, it generates a tensive force 45 between the tailpiece 32 and the neck 26. The tensive force 45, depicted in FIG. 7, restricts the neck 26 from pivoting backwards towards the back face 18. In the absence of the tensive force 45, and considering the neck 26 is both slidably and pivotally connected to the body 12, the neck 26 would pivot and/or slide back towards the back face 18. The tensive force 45 may also be described as emanating from the taut engagement of the plurality of strings 34 between the front surface of the neck 30 and the tailpiece 32. As such, the tensive force 45 provides the primary motivation to keep the instrument 10 in the playing position.

In order to collapse the musical instrument 10, the tuning pegs (not shown) must be adjusted to remove some tension thereby allowing the tailpiece 32 to be disengaged from the soundboard 14, or the body 12 in general. Alleviating the tensive force 45 between the tailpiece 32 and the elongated neck 26 allows the neck 26 to pivot and slide towards the back face 18. This operation, illustrated in FIGS. 1*a*-1*e*, effectively collapses the musical instrument 10 into a form factor more appropriate and secure for traveling.

Figure 4A:
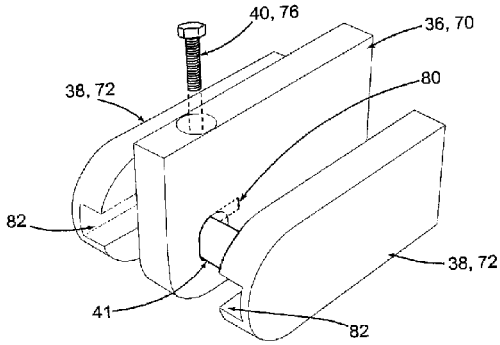
FIG. 4*a* is an exploded perspective of the connecting member allowing the neck to slide and pivot relative to the body.
Figure 4B:
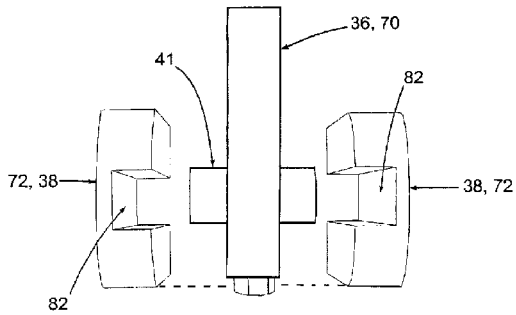
FIG. 4*b* is an exploded end view of the connecting member.
Figure 8B:
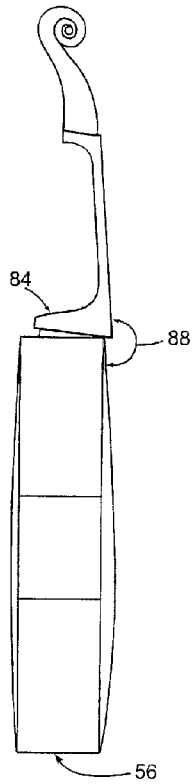
FIG. 8*b* is an exaggerated side view of the instrument showing the adjustment of the action.

As shown in FIGS. 4*a*-4*b*, the musical instrument 10 also comprises a positioner 36, or positioning member 70, engaging the neck 26 and a base member 38, or frame member 72, engaging the body 12. Furthermore, an adjustment member 40, or action setting member 76, is operably associated with the positioner 36 and the base member 38. Adjusting the adjustment member 40 exerts opposing forces on the positioner 36 and the base member 38 in a way that allows the angle 88 between the neck 26 and the body 12 to controllably change. FIG. 8*b* illustrates an exaggerated change in the angle 88 caused by an adjustment of the adjustment member 40. The relationship between the positioner 36, the base member 38, and the adjustment member 40 will be expounded upon below in terms of the frame member 72, the positioning member 70, and the action setting member 76.

The coupling between the neck 26 and the body 12 may be through a connecting member 60 which includes the positioning member 70, the frame member 72, the action setting member 76, and a guide 74 as depicted in FIGS. 4*a*-4*b*. The guide 74 may be located in either the positioning member 70 or frame member 72. In the particular embodiment illustrated in FIGS. 4*a*-4*b*, the positioning member 70 has the guide 74, although as mentioned above, the invention is not limited to this configuration. When the instrument 10 is in a playing position the guide 74 extends in a direction between the bottom end of the neck 64 and the near end of the body 28.

Figure 4C:
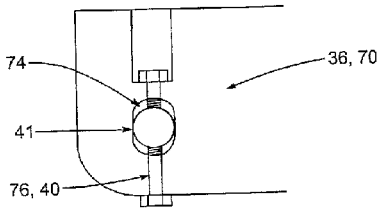
FIG. 4*c* is a side view of the connecting member.

In the embodiment illustrated in FIGS. 4*a*-4*c*, the guide 74 is an oblong slot in the positioning member 70. The action setting member 76 is operably associated with both the positioning member 70 and the frame member 72. As can be clearly seen in FIGS. 4*a*-4*b*, the follower 41 is received into the guide 74 and also engages frame member 72 through channels 82 cut into the frame member 72. The width of the follower 41 is slightly less than the width of the channels 82. By slightly less it is meant that the follower 41 may be received in the channels 82 and slide therein but without any "play" unnecessary to accomplish the aforementioned interactions. The action setting member 76, a screw in this embodiment, is associated with the frame member 72 through the follower 41. It is well appreciated that the action member could take a litany of forms. The follower 41 has a threaded bore sized to accept the action setting member 76. The guide 74 is oblong or stretched in a direction between the bottom end of the neck 64 and the near end of the body 28. The length of the guide 74 in its elongated direction is greater than the width of the follower 41. This difference 80 between the width of the follower 41 and the length of the elongated guide 74 is shown in FIG. 4*a*. The difference 80 allows the follower 41 to move in the guide 74.

Figure 4D:
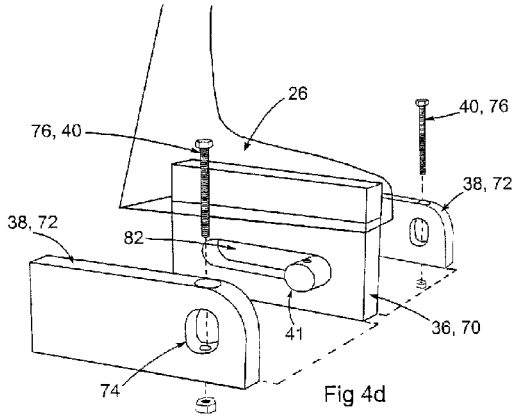
FIG. 4*d* is an exploded perspective of an alternative embodiment of the connecting member.

In an alternative embodiment shown in FIG. 4*d*, the frame member 72 has the guide 74 and the positioning member 70 contains the channel 82. The effect of the interaction between the positioning member 70, the frame member 72, the guide 74, and the follower 41 in this alternative embodiment is the same as that described above for the embodiment shown in FIGS. 4*a*-4*b*.

Figure 8A:
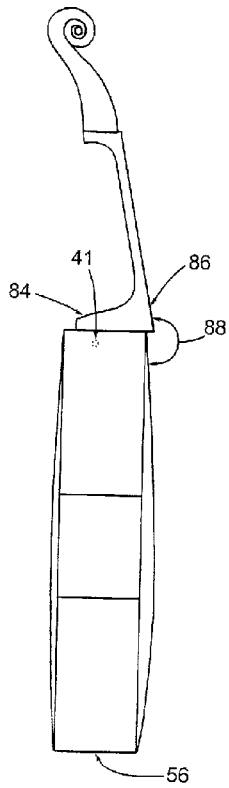
FIG. 8*a* is a side view of the instrument.
Figure 4E:
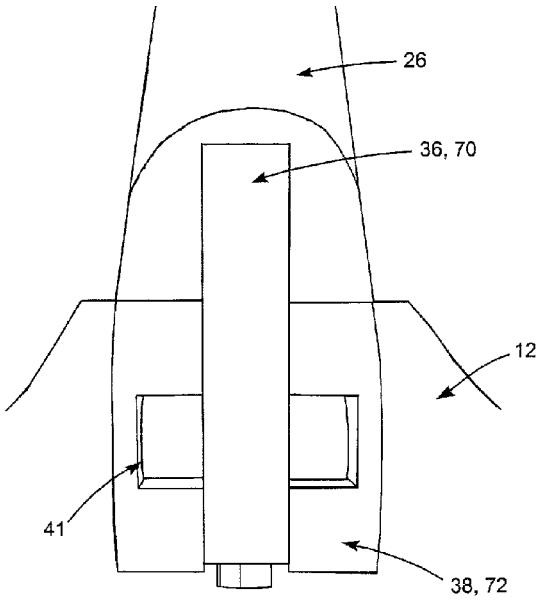
FIG. 4*e* is a front view of the connecting member allowing the neck to slide and pivot relative to the body

As the action setting member 76, which is received in the threaded follower 41, is adjusted, it either pulls or pushes the follower 41, depending on how the action setting member 76 is adjusted, along the elongated length of the guide 74. Because the width of the guide 74 and the channels of the frame member 72 are similar, the force imparted by adjusting the action setting member 76 can only cause the follower 41 to traverse the length of the guide 74. As the follower 41 moves along the guide 74 opposing forces are placed on the neck 26, through the positioning member 70, and the body 12, through the frame member 72. Now referring to FIGS. 8*a* and 8*b*, the movement of the follower 41 along the guide 74 exerts a force on the heel of the neck 84 either pulling the heel of the neck 84 towards the bottom end of the body 56 or away from the bottom end of the body 56. As discussed earlier the tensive force 45 holds the toe of the neck 86 firmly against the body 12. Consequently, the movement of the follower 41 along the guide 74 pivots the heel of the neck 84 relative to the toe of the neck 86 thereby causing the angle 88 between the neck 26 and the body 12 to controllably, or incrementally, change. Changing the angle 88 allows precise control of the action of the stringed musical instrument 10. As it is known to those of ordinary skill in the art, the action refers to the height of the plurality of strings 34 above the fingerboard 48.

From the preceding description it is also apparent how the neck 26 can both slide relative to the body 12 and pivot relative to the soundboard 14. Again referring to FIGS. 4*a*-4*b*, the neck 26, via the follower 41, is able to slide along the length of the channels 82 to move laterally relative to the body 12. Additionally, it is manifest that the neck 26 can pivot by virtue of its acceptance of the follower 41 in the guide 74. The positioning member 70 is free to rotate around the follower which, in turn, allows the neck 26 to rotate around the follower 41. The frame member 72 prevents the positioning member 70 from releasing the follower 41 thereby facilitating the pivoting and sliding action of the neck 26 without concern that the follower 41 will accidentally disengage from the positioning member 70.

The connecting member 60 may also have a block member 62 as shown in FIG. 7. The block member 62 restricts the neck 26 from pivoting beyond a predetermined position towards the soundboard 14 under the tensive force 45. In the preferred embodiment, the block member 62 is proximate the top portion of the body 28 and hence the soundboard 14. The block member 62 is positioned relative to the connecting member 60 and the neck 26 to prohibit the neck from hinging or pivoting forward towards the soundboard 14 by virtue of the tensive force 45. Because the plurality of strings 34 are tautly engaged between the front surface of the neck 30 and the tailpiece 32, if it were not for the block member 62, the taunt engagement of the plurality of the strings 34 between the tailpiece 32 and the front surface of the neck 30 would cause the neck 26 to rotate towards the soundboard 14. Thus, the predetermined position from which the block member 62 prevents the neck 26 from pivoting beyond is analogous to the playing position.

Now referring to FIGS. 6*a*, 6*b*, 6*c*, 9*a* and 9*b*, in one preferred embodiment the stringed musical instrument 10 may have an entryway 42 or door 42 in the back face 18 of the body 12 that provides access to the sound chamber 24. The entryway 42 is sized and positioned to receive the neck 26 in the sound chamber 24 when the neck 26 is pivoted and moved laterally relative to the body 12 into the sound chamber 24. Preferably, the entryway 42 is indiscernible from the rest of the body when the entryway 42 is in a closed position sealing the sound chamber 24. The entryway 42 may be attached to the back face 18 in a myriad of ways. For example, but not limited to, the entryway 42 may be hinged to the body 12, press fit into the body 12, or slid into the body 12 (i.e. the body 12 may be grooved to accept the entryway 42).

Because the neck 26 is slidably and pivotedly connected to the body 12, the neck 26 is able to fluidly position itself into and store in the sound chamber 24 by passing through the entryway 42. Thus, the entryway 42 allows the instrument 10 to be folded into a form factor not disparate from that of the body 12 alone without the need to recess or otherwise deform the body 12 of the instrument 10. As discussed above, the ability of the invention to fold without the necessity of a recess engenders the instrument 10 with the ability to maintain its true sound.

As shown in FIG. 3 the musical instrument 10 may also have at least one securement member 44 or neck holder 44 positioned in the sound chamber 24 capable of restraining and storing the neck 26 after the neck 26 has been received through the entryway 42 into the sound chamber 24. The securement member 44 may be a multi-prong type press fitting, a snap fit fastener, or a sleeve. However, it will be obvious to one of ordinary skill in the arts that a multitude of fastener designs would accomplish the same end. In another preferred embodiment (not shown) the securement member 44 may be associated with the connecting member 60 and may embody a detent or hitch along range of motion of the connecting member 60 that allows the neck 26 to snap or slide into a secured, fully collapsed position. With the detent or hitch securing embodiment the neck 26 could be unfurled by firmly shifting the neck 26 out of the hitch or detent and pulling the neck 26 into a playing position.

Additionally, the entryway 42 may be further sized and positioned to accept the disengaged tailpiece 32 and the plurality of strings 34 so that they may be restrained in the sound chamber 24 by a retaining member (not shown), or a tailpiece holder, located in the sound chamber 24, which is adapted to restrain and store the tailpiece 32. As the plurality of strings 34 are coupled to the tailpiece 32, the plurality of strings 34 will also be restrained and stored inside the sound chamber 24. In one embodiment, a single retaining member will be a press fit type member. However, the present invention envisions any retaining member that may allow the tailpiece 32 to be easily restrained and removed when desired. The placement of the retaining member with one end of the plurality of strings 34 attached thereto will allow the plurality of strings 34 to naturally lie between the retaining member and the neck 26 so as to prevent the plurality of strings 34 from being damaged or otherwise kinked once they are stored in the sound chamber 24.

Figure 2A:
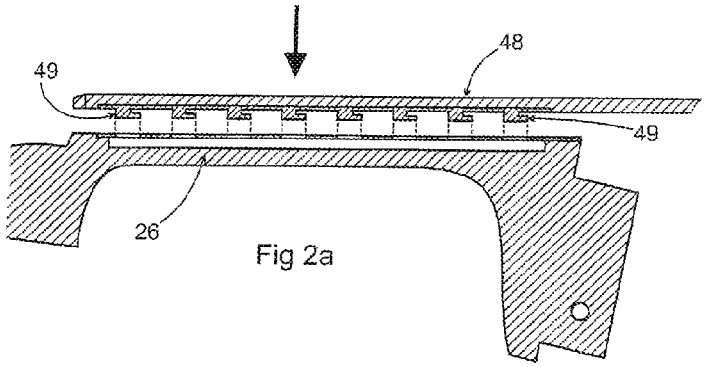
FIGS. 2*a* and 2*b* depict a cross sectional view of the fingerboard engaging the neck.
Figure 2B:
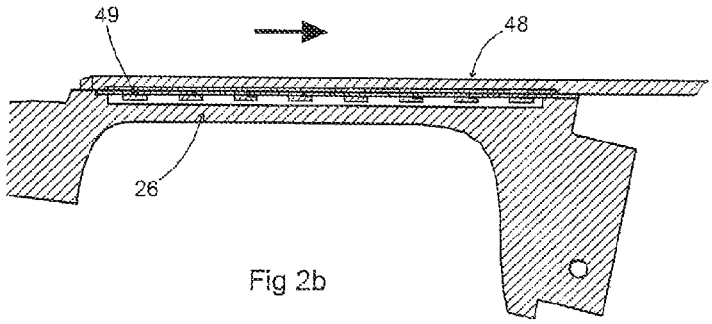
Figure 9A:
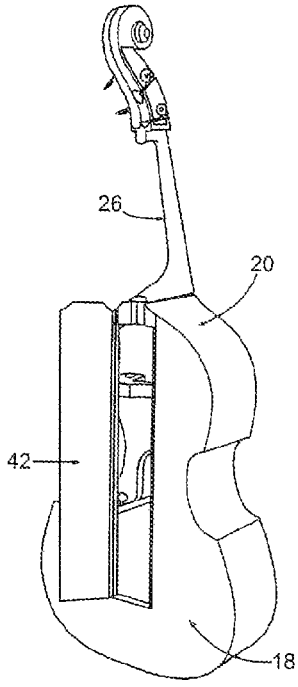
FIG. 9*a* is a perspective view of one preferred embodiment of the instrument with the door in the open position.
Figure 9B:
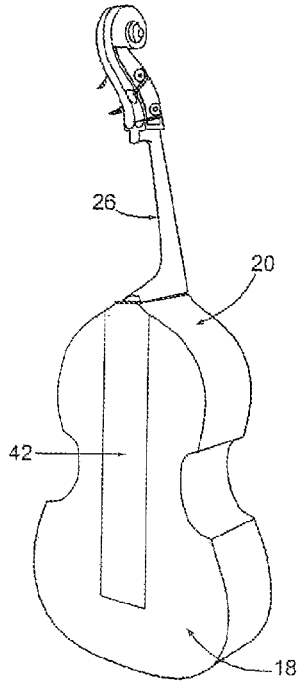
FIG. 9*b* is a perspective view of one preferred embodiment of the instrument with the door in the closed position

The stringed musical instrument 10 may also have a fingerboard 48 demountedly coupled with the neck 26 as shown in FIGS. 2*a*-2*b* (which show a cross-section of the instrument 10 taken at line 2*b* of FIG. 3). FIG. 5 shows the fingerboard 48 extending from the neck 26 to the body 12. As such, the fingerboard 48 must be removed before the neck 26 can be collapsed into the sound chamber 24. In one preferred embodiment, shown in FIGS. 2*a*-2*b*, the fingerboard 48 has hooks 49 that may be accepted into the neck 26 which has complimentary recesses to allow the hooks 49 to slide into the neck 26 and be secured therein.

Now referring to FIG. 3, the sound chamber 24 may also have at least one fastener 50, or fingerboard holder 50, adapted to restrain and store the demountable fingerboard 48. Similarly to the retaining member, the fastener 50 may be a press fit type retainer, a sleeve, or a latch. However, the present invention envisions any fastener 50 that may allow the fingerboard 48 to be easily restrained and removed when desired.

Figure 10:
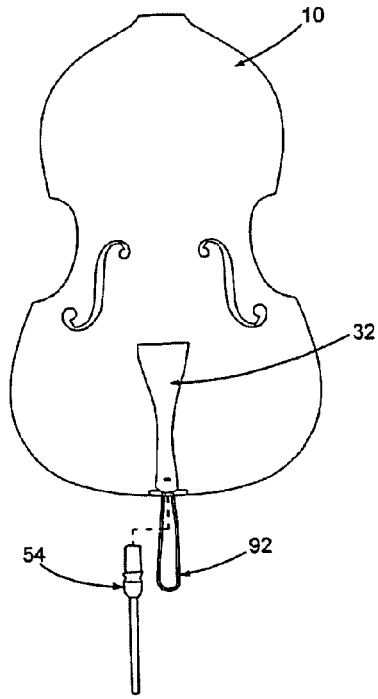
FIG. 10 is a front view of the instrument showing the relationship between the endpin, tail wire, and tailpiece.

FIG. 5 depicts an endpin 54 detachedly coupled to the bottom end of the body 56. The endpin 54 is pressed against the floor so that the instrument 10 is maintained over the floor. The endpin 54 is proximate the tailpiece 32. Preferably the endpin 54 is coupled to the body 12 by a press fit engagement. The sound chamber 24 has one endpin holder 58 that is positioned and sized to accept and secure the endpin 54 in the sound chamber 24. Preferably the endpin holder 58 is a sleeve that the endpin 54 can slide into to. However, the endpin holder may also take the form of a pronged type press fit fastener or any other fastener that allows the endpin 54 to be securely stored in the sound chamber 24. The endpin 54 may also provide an anchor to which the tailpiece 32 may be secured to the body 12 through a tail wire 92, as shown in FIG. 10. In an alternative embodiment, the tailpiece 32 is slidably engaged to the body 12. More specifically in the alternative embodiment, the tailpiece 32 would have an appendage that could be inserted into a complementary recess in the body 12 thereby securing the tailpiece 32.

As is manifest from the preceding disclosure, the features of the instrument 10 allow it to be collapsed and set up without an arduous undertaking. In fact, the process can be completed in only a matter of minutes. The expedited conversion process, from a playing position to a collapsed form or vice versa, inherent in the present invention, does not require the user to have any special knowledge or training nor does it necessitate the use of any tools. Consequently, the present invention allows even a casual user to painlessly and rapidly collapse and set up the instrument 10.

Thus, it is seen that the stringed musical instrument of the present invention readily achieves the ends and advantages mentioned as well as those inherent therein. Although certain preferred embodiments of invention have been illustrated and described for purposes of the present disclosure, numerous changes may be made by those skilled in the art which changes are encompassed within the scope and spirit of the present invention and defined by the appended claims.

What is claimed is:

1. A collapsible acoustic stringed instrument comprising:

a body comprising a soundboard having a first perimeter, a back face opposing the soundboard and having a second perimeter, a spacer extending between the first perimeter and the second perimeter, wherein the spacer, the soundboard, and the back face define a sound chamber;

an elongated neck pivotally and laterally coupled to a top portion of the body, the lateral coupling further comprising a channel having a length extending substantially the width of the top portion of the body transverse the length of the body, wherein the neck is able to slide relative to the body between the soundboard and the back face along the length of the channel while remaining coupled to the body, and the neck is able to pivot relative to the soundboard backward towards the back face while remaining coupled to the body, wherein the neck is able to slide and pivot between a playing position and a stored position within the sound chamber while remaining coupled to the body; and wherein the collapsible acoustic stringed instrument further comprises one of a cello and a bass.

2. The collapsible stringed instrument of claim 1 wherein the neck has a front surface and further comprising:

a tailpiece detachably engaged to at least a portion of the body; and a plurality of strings stretchedly engaged between the tailpiece and the front surface of the neck so that the stretched strings generate a tensive force between the tailpiece and the neck thereby restricting the neck from pivoting backward towards the back face.

3. The collapsible stringed instrument of claim 1 further comprising:

a positioner engaging the neck;

a base member engaging the body; and an adjustment member operably associated with the positioner and the base member, wherein adjusting the adjustment member exerts opposing forces on the positioner and the base member such that the opposing force controllably changes an angle measured between the neck and the body by pivoting the neck relative to the soundboard.

4. The collapsible stringed instrument of claim 1 further comprising:

an entryway in the back face of the body having an open position and a closed position, the entryway in the open position providing access to the sound chamber, wherein the entryway is sized and positioned to receive the neck in the sound chamber when the neck is pivoted and moved laterally relative to the body.

5. The collapsible stringed instrument of claim 4 further comprising:

a securement member positioned in the sound chamber and adapted to restrain and store the neck.

6. The collapsible stringed instrument of claim 4 further comprising:

a fingerboard demountably coupled to the neck; and the sound chamber having at least one fastener adapted to restrain and store the fingerboard.

7. An acoustic foldable stringed musical instrument comprising:

a hollow body having a playing face with a first border, a back plate parallelly opposing the playing face, the back plate having a second border, a periphery member connecting the first border of the playing face to the second border of the back plate, an interior bounded by the playing face, the back plate, and the periphery member, a door in the back plate having an open position and a closed position, wherein the interior can be accessed through the door; and a neck pivotally engaging the hollow body, wherein the door is sized and positioned so that when the door is opened the neck may pivot into the interior of the body, said pivotal engagement further comprising a channel having a length extending substantially the width of the periphery member transverse a length of the hollow body such that the neck is able to slide along the length of the channel.

8. The foldable stringed musical instrument of claim 7 further comprising:

a tailpiece removably connected the hollow body.

9. The foldable stringed musical instrument of claim 8 further comprising:

a plurality of strings distended between the tailpiece and the neck, wherein the distended plurality of strings provide a force that limits the neck from rotating backward towards the back plate.

10. The foldable stringed musical instrument of claim 9, wherein the interior of the hollow body has at least one retaining member positioned and sized to securely hold the tailpiece in the interior.

11. The foldable stringed musical instrument of claim 10 further comprising:

a fingerboard slidably engaging the neck so that the fingerboard may be removed from the neck, and wherein the interior of the hollow body has at least one fingerboard holder positioned and sized to secure the fingerboard in the interior.

12. The foldable stringed musical instrument of claim 11 further comprising:

an endpin detachably coupled to a bottom end of the hollow body, wherein the interior of the hollow body has at least one endpin holder positioned and sized to secure the endpin in the interior.

13. The foldable stringed musical instrument of claim 7, wherein the pivotally engaged neck is also slidably engaged to the hollow body.

14. A collapsible stringed musical instrument comprising:

an instrument base comprising a belly, a back surface, a chamber disposed between the belly and the back surface, and a door having an open position and a closed position located on the back surface, wherein the door in the open position allows ingress into the chamber;

an elongated neck comprising an anterior surface;

a connecting member comprising a block member and pivotally and slidably joining a bottom end of the elongated neck to a near end of the instrument base, wherein the connecting member is adapted to allow the neck to slide and pivot while remaining joined to the instrument base from a first position, defined by the neck and the instrument base in an extended collinear relationship, into the chamber, and wherein the block member restricts the neck from pivoting beyond a predetermined position towards the belly;

a tailpiece detachably engaging at least a portion of the belly;

a plurality of strings tautly engaged between the anterior surface of the neck and the tailpiece so that the taut engagement of the plurality of strings to the neck and the tailpiece restricts the neck from pivoting backward towards the back surface of the instrument base;

whereby the tailpiece may be detached from the belly so that the neck is allowed to slide relative to the connecting member along one or more channels defined substantially the distance between the belly and the back surface, and the neck is allowed to pivot from the first position into the chamber, and wherein the collapsible stringed instrument further comprises one of a cello and a double bass.

15. The collapsible stringed musical instrument of claim 14 further including a neck holder, located and dimensioned to secure the neck as the neck slides and pivots through the door and into the chamber.

16. The collapsible stringed musical instrument of claim 14 further including a tailpiece holder located and sized to receive and secure the detachable tailpiece in the chamber.

17. The collapsible stringed musical instrument of claim 14 further comprising:

a fingerboard slidably coupled to the neck, and further including a fingerboard holder located and sized to receive and secure the fingerboard in the chamber.

18. The collapsible stringed musical instrument of claim 14 further comprising:

an endpin detachably coupled to a bottom portion of the instrument base, and an endpin holder located and sized to receive and secure the endpin in the chamber.

19. The collapsible stringed musical instrument of claim 14, wherein the connecting member further comprises:

a positioning member engaging the neck;

a frame member engaging the instrument base, wherein one of the positioning and the frame members has a guide and the other of the positioning and frame members is operably associated with the guide, and wherein the guide extends in a direction between the bottom end of the elongated neck and the near end of the instrument base; and an action setting member operably associated with the positioning member and the frame member, wherein manipulating the action setting member causes the one of the positioning and the frame members operably associated with the guide to follow the guide resulting in the bottom end of the neck incrementally moving relative to the instrument base.

* * * * *